US005584364A

United States Patent [19]

Sakita

[11] Patent Number: 5,584,364

[45] Date of Patent: Dec. 17, 1996

[54] ELEVATOR SYSTEM

[76] Inventor: Masami Sakita, 1259 El Camino Real #121, Menlo Park, Calif. 94025

[21] Appl. No.: 520,292

[22] Filed: Aug. 28, 1995

[51] Int. Cl.[6] ..... B66B 9/00

[52] U.S. Cl. ..... 187/249; 187/257

[58] Field of Search ..... 187/249, 256, 187/257, 404, 406, 405; 414/630

[56] References Cited

U.S. PATENT DOCUMENTS

| | | | |
|---|---|---|---|
| 1,458,881 | 6/1923 | Gromer | 187/16 |
| 1,973,920 | 9/1934 | Wilson | 187/16 |
| 1,976,495 | 10/1934 | Halfvarson | 187/249 |
| 4,632,224 | 12/1986 | Nowak et al. | 187/29 R |
| 5,107,962 | 4/1992 | Ekholm | 187/249 |
| 5,419,414 | 5/1995 | Sakita | 187/391 |

*Primary Examiner*—Kenneth Noland
*Attorney, Agent, or Firm*—Victor R. Beckman

[57] ABSTRACT

An elevator system is shown which includes first and second horizontally spaced elevator shafts. First and second independently operated elevator cars are located in the first shaft, and third and fourth elevator cars are located in the second shaft. The second and fourth elevator cars are interconnected by a first drive rope, and the first and third elevator cars are interconnected by a second drive rope. A first drive motor is connected to the first drive rope for simultaneously moving the second and fourth elevator cars in opposite directions, and a second drive motor is connected to the second drive rope for simultaneously moving the first and third elevator cars in opposite directions. The upper-most elevator cars in each shaft are provided with vibration dampers through which the drive ropes for the lower most elevator cars in each shaft extend for damping vibration of the drive ropes extending therethrough. The lower-most elevator cars in each shaft also are provided with vibration dampers through which compensating ropes for the upper-most elevator cars in each shaft extend for damping vibration of the compensating ropes. Movable vibration damper units carrying vibration dampers for damping vibration of drive and compensating ropes are located above, below, and intermediate adjacent elevator cars. Elevator cars include a car frame and passenger cage vertically movably mounted thereon. By negative feedback, the passenger cage is vertically moved dependent upon passenger load and position of the car frame along the shaft to substantially isolate the passenger cage from vertical vibration of the car frame to which drive ropes are affixed.

15 Claims, 6 Drawing Sheets

ELEVATOR SYSTEM

BACKGROUND OF THE INVENTION

1. Field of the Invention

This invention relates generally to elevator systems that are particularly well adapted for use in tall buildings which systems occupy less building space and require less energy to operate than conventional elevator systems.

2. Description of Related Art

Currently, a block-shaped building, in which the area of floor space is the same from the ground floor to the top floor, has a practical height limit of slightly over 100 floors. This is because providing enough elevators to service passenger demand for the full floor space at higher floors would be impractical. In all tall buildings, almost the entire ground floor is used for elevators, waiting space, and access to them. A 100-story building would use up to 30 percent of the entire building floor space for elevators and waiting space. Because of the amount of space required, overall space used for elevators is extremely expensive, and any savings provided by a more efficient elevator system could create a substantial amount of useable, valuable, real estate.

Different methods have been suggested or tried to achieve a very efficient elevator system. To this end, different methods of operating the system have been employed including the "express" method wherein cars service the ground floor and different groups of upper floors. Another method is to increase the cruising speed to the maximum limit. Another is to use two-story, multicompartment, cars such as shown in U.S. Pat. No. 4,632,224.

The basic strategy for increasing efficiency is to reduce the round-trip time and/or increase the number of passengers carried on each trip. Although round-trip time may be reduced by minimizing the number of stops on a trip, this method may not be practical for real-world applications. If elevator cars are operated at high speeds, car vibration may become intolerable in a tall elevator shaft due to vibration of the drive ropes transmitted to the elevator car. Although two-story elevator cars can double the number of passengers carried on a trip, there will be a significant increase in round-trip time if both upper and lower compartments are allowed to stop at each floor. Also, passengers will be inconvenienced if the upper compartment is allowed to stop only at even numbered floors and the lower compartment at odd numbered floors.

Elevator systems that include a plurality of elevator cars in the same elevator shaft are well known as shown in applicant's U.S. Pat. No. 5,419,414. There, a counterweight is provided for each of the elevator cars. Also, elevator systems that include first and second elevator shafts are known, wherein elevator cars are moved upwardly in one shaft and downwardly in the other. Such a system is shown in U.S. Pat. No. 1,458,881 wherein endless chains for the support of elevator cars continuously travel up one shaft and down the other.

SUMMARY OF THE INVENTION

The elevator system of the present invention includes first and second vertical elevator shafts at a horizontally spaced distance apart. At least first and second elevator cars are located in the first shaft which cars are movable along a first vertical axis. Similarly, at least third and fourth elevator cars are located in the second shaft which cars are movable along a second vertical axis. The second elevator car is located beneath the first elevator car in the first shaft, and the third elevator car is located beneath the fourth elevator car in the second shaft. The second and fourth elevator cars are interconnected by first drive rope means connected to a first motor for simultaneously moving said second and fourth elevator cars in opposite directions along said first and second vertical axes. Similarly, the first and third elevator cars are interconnected by second drive rope means connected to a second motor for simultaneously moving said first and third elevator cars in opposite directions along said first and second vertical axes. With this arrangement, no elevator car counterweights are required since each car serves as a counterweight for another car.

Vibration damping means are affixed to the elevator cars through which drive and compensating rope means for other cars extend for damping vibration of the drive and compensating ropes thereat. Also, movable vibration damping units are located above, below, and between elevator cars, to which units vibration damping means are affixed. Drive and compensating rope means for elevator cars and for other vibration damping units extend through vibration damping means affixed to the movable vibration damping units for damping vibration of drive and compensating ropes thereat. The movable vibration damping units that are above the upper elevator cars are moved in the same direction as the upper elevator cars at substantially one-half the rate of movement of the upper cars. Similarly, the movable vibration units that are below the lower elevator cars are moved in the same direction as the lower elevator cars at substantially one-half the rate of movement of the lower cars. The movable vibration damping units located between adjacent elevator cars are maintained at a location substantially midway between adjacent elevator cars.

Additional vibration control means for substantially isolating passengers from any remaining vibration of drive and compensating rope means are provided by use of passenger cars that include a passenger cage supported by a car frame. The car frame is attached to the drive rope means, and means are provided for moving the passenger cage up and down relative to the car frame. First sensing means, such as load weight sensing means, provides a measure of vertical vibration of the passenger cage relative to the car frame. Second sensing means, such as vertical position sensing means, provides a measure of vertical vibration of the car frame relative to the associated elevator shaft during travel along the elevator shaft. Means responsive to the first and second sensing means are provided for controlling the moving means for vibrating the passenger cage relative to the car frame to substantially isolate the passenger cage from vertical vibration of the car frame relative to the elevator shaft. Vertical vibration of the car frame relative to the elevator shaft is cancelled from the passenger cage by substantially equal but opposite vibration of the passenger cage relative to the car frame.

DETAILED DESCRIPTION OF THE INVENTION

Figure 1:
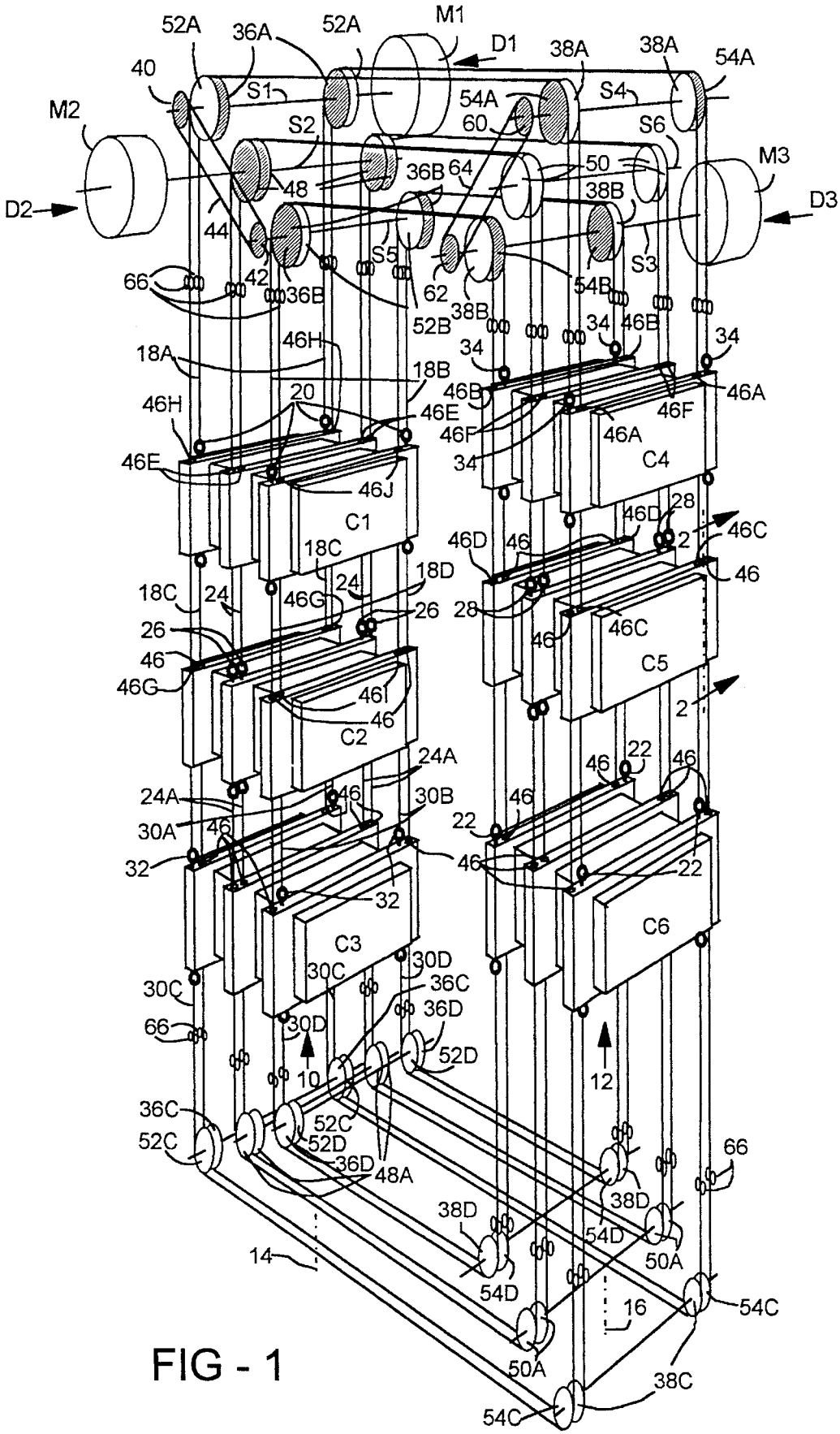
FIG. 1 is a simplified diagrammatic perspective view showing an elevator system embodying the present invention.

Reference first is made to FIG. 1 of the drawings wherein an elevator system for use in a multistory building is shown which system includes first and second vertical elevator shafts 10 and 12 within each of which shafts a plurality of elevator cars are located for up and down movement therein. For purposes of illustration, three elevator cars C1, C2 and C3 are shown in shaft 10, and three elevator cars C4, C5 and C6 are shown in shaft 12. Elevator cars C1, C2 and C3 are independently movable within shaft 10 along vertical axis 14, and cars C4, C5 and C6, which are connected to cars C3, C2 and C1, respectively, are movable within shaft 12 along vertical axis 16.

Cars C1 and C6 are interconnected by drive rope means which, for purposes of illustration, comprise four drive ropes, two of which are identified by reference character 18A and two of which are identified by reference character 18B. For purposes of illustration, these drive ropes are shown attached to car C1 by attachment lugs 20 and to car C6 by attachment lugs 22. Cars C2 and C5 are interconnected by drive rope means comprising four drive ropes 24 attached to car C2 by attachment lugs 26 and to car C5 by attachment lugs 28. Finally, cars C3 and C4 are shown interconnected by drive ropes 30A and 30B attached to car C3 by attachment lugs 32 and to car C4 by attachment lugs 34. Guide means, not shown, guide the elevator cars for movement along the vertical axes 14 and 16 upon operation of associated motors.

Drive means D1, D2 and D3, comprising drive motors M1, M2 and M3, are connected to the respective pairs of cars C1 and C6, C2 and C5, and C3 and C4 through their associated drive ropes for moving the cars within the elevator shafts 10 and 12 along vertical axes 14 and 16. In FIG. 1, motor shafts of motors M1, M2 and M3 are identified by reference characters S1, S2 and S3, respectively. Drive ropes 18A, 18A for cars C1 and C6 are wound around drive sheaves 36A, 36A that are affixed to motor drive shaft S1. (To facilitate an understanding of the invention, sheaves affixed to shafts are shown shaded whereas sheaves freely rotatable upon shafts are shown without shading.) From drive sheaves 36A, 36A, drive ropes 18A, 18A pass over idler sheaves 38A, 38A rotatably mounted on shaft S4 in the connection thereof to car C6. Drive ropes 18B, 18B for cars C1 and C6 are wound around drive sheaves 36B, 36B affixed to shaft S5. Shaft S5, in turn, is connected to motor shaft S1 through sheaves 40 and 42 affixed to said shafts S1 and S5, respectively, and a connecting belt 44 extending between sheaves 40 and 42. From drive sheaves 36B, 36B drive ropes 18B, 18B pass over idler sheaves 38B, 38B rotatably mounted on motor shaft S3 in connection thereof to car C6.

From the above, it will be seen that paired elevator cars C1 and C6 are simultaneously moved in opposite directions through interconnecting drive ropes 18A and 18B upon operation of drive motor M1, paired elevator cars C2 and C5 are simultaneously moved in opposite directions through interconnecting drive ropes 24 upon operation of drive motor M2, and paired elevator cars C3 and C4 are simultaneously moved in opposite directions through interconnecting drive ropes 30A and 30B upon operation of drive motor M3.

Figure 2:
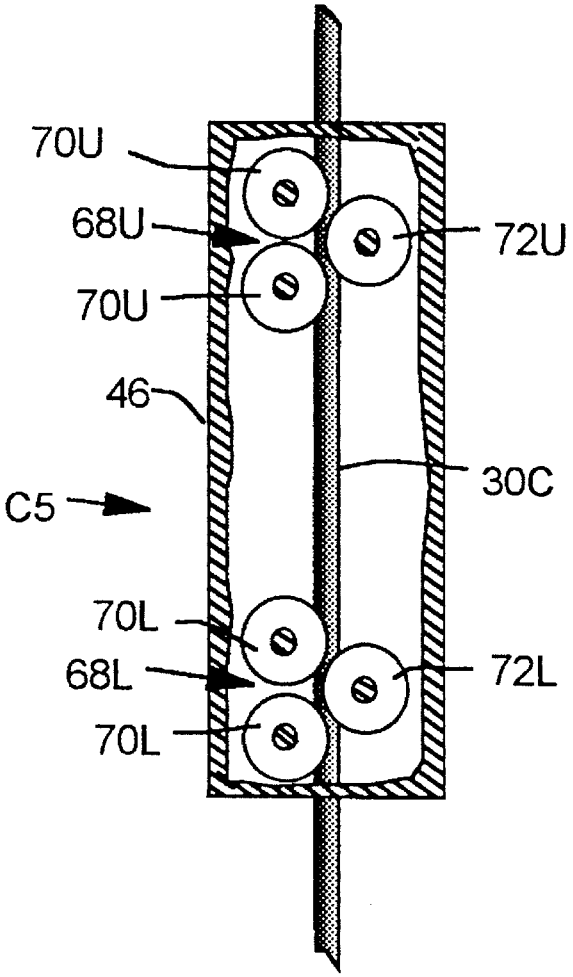
FIG. 2 is an enlarged sectional view of a vibration damping unit taken along line 2—2 of FIG. 1.
Figure 3:
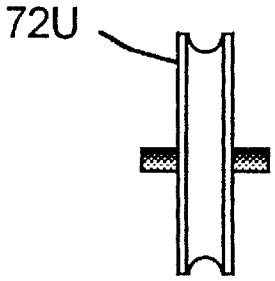
FIG. 3 is an enlarged elevational view of one of the sheaves employed in the vibration damping unit shown in FIG. 2.

In the illustrated embodiment of the invention, elevator cars are provided with a plurality of vibration damping means through which drive ropes, and compensating ropes described below, extend for damping vibration of ropes thereat. Elevator car C4 is shown provided with vibration damping means 46A through which drive ropes 18A extend, and vibration damping means 46B through which drive ropes 18B extend. Similarly, elevator car C5 is shown provided with vibration damping means 46C through which drive ropes 18A extend, and vibration damping means 46D through which drive ropes 18B extend. In FIG. 1, only open upper ends of the vibration damping means are seen. All of the vibration damping means may be of the same construction, such as shown in FIGS. 2 and 3 described hereinbelow.

As seen in FIG. 1, drive ropes 24 extend upwardly from elevator car C2, through vibration damping means 46E affixed to elevator car C1, and are wound around drive sheaves 48 affixed to motor shaft S2 of drive motor M2. From drive sheaves 48, the drive ropes pass over idler sheaves 50 mounted on a shaft S6 and thence extend downwardly to elevator car C5 through vibration damping means 46F affixed to elevator car C4.

Drive ropes 30A for elevator cars C3 and C4 extend upwardly from car C3, through vibration damping means 46G affixed to elevator car C2, through vibration damping means 46H affixed to elevator car C1, and extend over idler sheaves 52A rotatably mounted on shaft S1. From idler sheaves 52A, drive ropes 30A extend around drive sheaves 54A affixed to shaft S4, and thence downwardly where they are affixed to elevator car C4. Drive ropes 30B for elevator cars C3 and C4 extend upwardly from elevator car C3, through vibration damping means 46I affixed to elevator car C2, through vibration damping means 46J affixed to elevator car C1, and over idler sheaves 52B rotatably mounted on shaft S5. From idler sheaves 52B, drive ropes 30B extend around drive sheaves 54B affixed to motor shaft S3, and thence downwardly to elevator car C4. Shaft S4 to which drive sheaves 54A are affixed is connected to motor shaft S3 of drive motor M3 through sheaves 60 and 62 affixed to said shafts S4 and S3, respectively, and a connecting belt 64 extending between the sheaves 60 and 62 whereby drive sheaves 54A and 54B for elevator cars C3 and C4 are simultaneously rotated upon operation of motor M3.

Preferably, the elevator system is provided with compensating ropes such as shown in FIG. 1. Compensating ropes 18C and 18D are affixed to and extend between elevator cars C1 and C6. These ropes extend around idler sheaves 36C, 38C, 36D and 38D adjacent the bottom of the shafts 10 and 12. Compensating ropes 24A affixed to elevator C2 and C5 extend around idler sheaves 48A and 50A adjacent the bottom of shafts 10 and 11. Finally, compensating ropes 30C and 30D affixed to elevator cars C3 and C4 extend around idler sheaves 52C, 54C, 52D and 54D adjacent the bottom of elevator shafts 10 and 11. The idler sheaves for the compensating ropes are rotatably mounted on shafts adjacent the bottom of elevator shafts 10 and 12.

As with the drive ropes, the compensating ropes also extend through vibration damping means affixed to elevator cars. For simplicity, vibration damping means affixed to elevator cars C2, C3, C5 and C6 through which compensating ropes extend are identified by reference character 46. Vibration of compensating ropes is minimized where the ropes extend through the vibration damping means for reducing the effect of rope vibration on elevator cars to which the ropes are attached. Also as seen in FIG. 1, each drive and compensating rope passes between spaced pairs of sheaves 66 adjacent the top and bottom of the elevator shafts to help guide and control vibration of the ropes thereat.

Reference now is made to FIGS. 2 and 3 of the drawings wherein one of the vibration damping means 46 is shown in detail. In FIG. 2, a vibration damping means 46 affixed to elevator car C5 is shown comprising first and second sets of rotatably mounted grooved sheaves 68U and 68L adjacent the upper and lower end of the elevator car between which the rope 30C extends. The upper set, or group, of sheaves 68U includes a pair of sheaves 70U at one side of rope 30C and a third sheave 72U at the opposite side of the rope at a height intermediate sheaves 70U. Similarly, the lower group of sheaves 68L includes a pair of sheaves 70L at one side of rope 30C and a third sheave 72L at the opposite side of the rope. All of the sheaves are grooved as illustrated in FIG. 3 wherein an elevational view of sheave 72U is shown. Each set of grooved sheaves substantially surrounds the rope thereby substantially damping transverse vibration of the rope thereat.

As noted above, elevator systems of this invention are particularly well adapted for use in very tall multistory buildings of, say, at least 100 floors in height. For the elevator system shown in FIG. 1 which includes three elevator cars in each shaft, the building may include three lower terminal floors and three upper terminal floors in which case the lowermost terminal floors would be serviced by elevator cars C3 and C6, the uppermost terminal floors would be serviced by elevator cars C1 and C4, and the intermediate terminal floors would be serviced by elevator cars C2 and C5. With the present invention, each pair of elevator cars is driven by its own motor, and the weight of an elevator car in one elevator shaft is counterbalanced by that of an elevator car in the other elevator shaft. Obviously, means, not shown, are included to prevent collision between adjacent cars in the same shaft.

Figure 4:
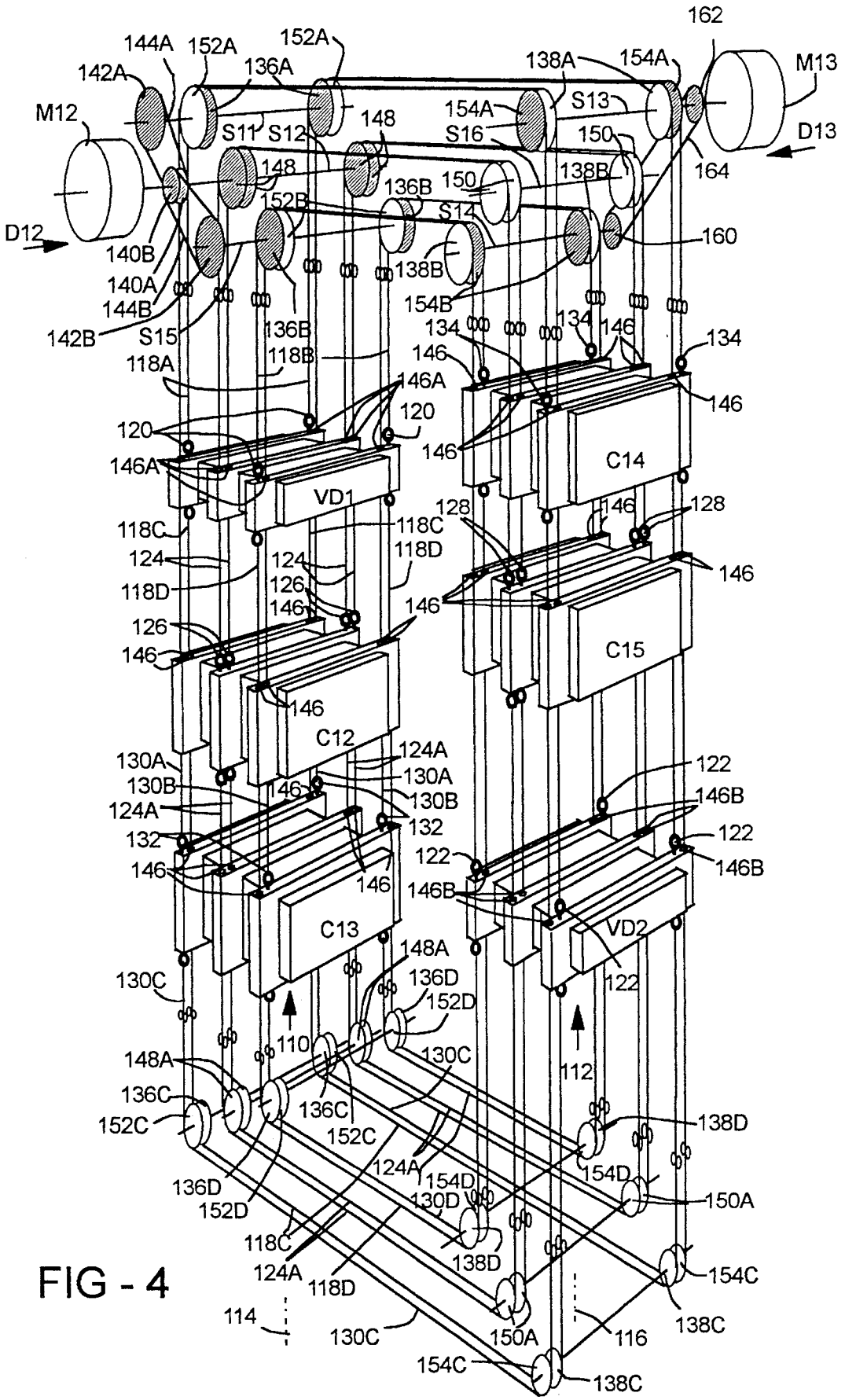
FIG. 4 is a simplified diagrammatic perspective view similar to that of FIG. 1 but showing a modified form of elevator system embodying this invention.

Reference now is made to FIG. 4 wherein a modified form of elevator system of this invention is shown which is similar to that shown in FIG. 1 but which includes only two vertically movable elevator cars C12 and C13 in a first elevator shaft 110, and two vertically movable elevator cars C14 and C15 in a second, parallel, elevator shaft 112. In this embodiment, a first vertically movable vibration damping unit VD1 is located above elevator cars C12, and an associated vibration damping unit VD2 is located beneath elevator car C15 in the second elevator shaft 112. Guide means, not shown, guide the elevator cars and vibration damping units for movement along the associated vertical axes 114 and 116. The vibration damping units VD1 and VD2 include a plurality of vibration damping means 146A and 146B for damping vibration of ropes extending therethrough. As seen in FIG. 4, drive ropes 124 for elevator cars C12 and C15, and drive ropes 130A and 130B for elevator cars C13 and C14, extend through vibration damping means 146A affixed to movable vibration damping unit VD1. Compensating ropes 124A for elevator cars C12 and C15, and compensating ropes 130C and 130D for elevator cars C13 and C14 extend through vibration damping means 146B affixed to movable vibration damping unit VD2.

Elevator cars C12, C13, C14 and C15 may be of the same construction as elevator cars C2, C3, C4 and C5, respectively, shown in FIG. 1 and described above. These cars include vibration damping means 146 through which drive and compensating ropes extend for damping vibration of the ropes. Vibration damping means 146 affixed to the elevator cars, vibration damping means 146A affixed to vibration damping unit VD1, and vibration damping means 146B affixed to vibration damping unit VD2 may be of the same type shown in FIGS. 2 and 3 described above, and no further description thereof is required.

As seen in FIG. 4, movable vibration damping units VD1 and VD2 are interconnected by drive rope means 118A and 118B which are attached by attachment lugs 120 to vibration damping unit VD1 and by attachment lugs 122 to vibration damping unit VD2. Cars C12 and C15 are interconnected by drive ropes 124 attached to car C12 by attachment lugs 126 and to car C15 by attachment lugs 128. Cars C13 and C14 are shown interconnected by drive ropes 130A and 130B attached to car C13 by attachment lugs 132 and to car C14 by attachment lugs 134.

In the FIG. 4 embodiment, which includes two pairs of elevator cars, only two drive motors are required for operating the same. Drive means D12, comprising drive motor M12, is connected both to interconnected cars C12 and C15, and to interconnected vibration damping units VD1 and VD2. As will become apparent hereinbelow, the vibration damping units VD1 and VD2 are driven in the same direction and at one-half the rate of respective elevator cars C12 and C15 upon operation of drive motor M12. Drive means D13, comprising drive motor M13, is connected to interconnected cars C13 and C14 for moving them up and down within their associated elevator shafts 110 and 112. In FIG. 4, motor shafts of motors M12 and M13 are identified by reference characters S12 and S13, respectively. As in the FIG. 1 arrangement sheaves affixed to shafts are shown shaded whereas sheaves freely rotatable upon shafts are shown without shading.

Drive ropes 124 for elevator cars C12 and C15 extend upwardly from car C12, through vibration damping means 146A affixed to vibration damping unit VD1, and are wound around drive sheaves 148 affixed to motor shaft S12 of drive motor M12. From drive sheaves 148, the drive ropes 124 pass over idler sheaves 150 mounted on shaft S16, and thence extend downwardly to elevator car C15 through vibration damping means 146 affixed to elevator car C14. Paired elevator cars C12 and C15 are simultaneously moved in opposite directions through interconnecting drive ropes 124 upon operation of drive motor M12.

Drive ropes 130A for elevator cars C13 and C14 extend upwardly from car C13, through vibration damping means 146 affixed to elevator car C12, through vibration damping means 146A affixed to vibration damping unit VD1, and thence over idler sheaves 152A rotatably mounted on shaft S11. From idler sheaves 152A, drive ropes 130A extend around drive sheaves 154A affixed to drive shaft S13 of motor M13. From drive sheaves 154A, drive ropes 130A extend downwardly where they are affixed to elevator car C14. Drive ropes 130B for elevator cars C13 and C14 extend upwardly from elevator car C13, through vibration damping means 146 affixed to elevator car C12, through vibration damping means 146A affixed to vibration damping unit VD1, and thence over idler sheaves 152B rotatably mounted on shaft S15. From idler sheaves 152B drive ropes 130B extend around drive sheaves 154B affixed to shaft S14, and thence downwardly to elevator car C14. Shaft S14 to which drive sheaves 154B are affixed is connected to motor shaft S13 of drive motor M13 through sheaves 160 and 162 affixed to said shafts S14 and S13, respectively, and a connecting belt 164 extending between the sheaves 160 and 162 whereby drive sheaves 154A and 154B are simultaneously rotated upon operation of motor M13. It will be seen, then, that paired elevator cars C13 and C14 are simultaneously moved in opposite directions through interconnecting drive ropes 130A and 130B upon operation of drive motor M13.

Drive ropes 118A and 118B for vibration damping units VD1 and VD2 are connected to drive motor M12 for elevator cars C12 and C15 through a 2 to 1 speed reduction mechanism whereby the vibration damping units are driven in the same direction as the associated elevator cars but at substantially one-half the velocity thereof. As seen in FIG. 4, drive ropes 118A for the vibration damping units extend upwardly from vibration damping unit VD1 and are wrapped around drive sheaves 136A affixed to shaft S11. From drive sheaves 136A, drive ropes 118A pass over idler sheaves 138A rotatably mounted on shaft S13. From idler sheaves 138A, drive ropes 118A extend downwardly through vibration damping means 146 affixed to elevator cars C14 and C15 to vibration damping unit VD2. Drive ropes 118B for the vibration damping units extend upwardly from vibration damping unit VD1 and are wound around drive sheaves 136B affixed to shaft S15. From drive sheaves 136B, drive ropes 118B pass over idler sheaves 138B rotatably mounted on shaft S14. From idler sheaves 138B, drive ropes 118B extend downwardly through vibration damping means 146 affixed to elevator cars C14 and C15 to vibration damping unit VD2.

As noted above, vibration damping units VD1 and VD2 are driven by drive ropes 118A and 118B extending therebetween. Also, as noted above, drive ropes 118A are wound upon drive sheaves 136A affixed to shaft S11, and drive ropes 118B are wound upon drive sheaves 136B affixed to shaft S15. Shafts S11 and S15 are connected through 2 to 1 speed reduction means to drive motor M12 whereby the vibration damping units VD1 and VD2 are moved at one-half the rate of elevator cars C12 and C15 upon energization of motor M12. The speed reduction mechanism for shaft S11 includes a sheave 142A affixed to the shaft, which sheave is connected by a belt 144A to a sheave 140A affixed to motor drive shaft S12. The speed ratio between sheave 142A and 140A is two-to-one whereby shaft S11 rotates at one half the rate of shaft S12 during energization of motor M12. Similarly, the speed reduction mechanism for shaft S15 includes a sheave 142B affixed to the shaft which sheave is connected by a belt 144B to a sheave 140B affixed to motor drive shaft S12. The speed ratio between sheave 142B and 140B is two-to-one whereby shaft S15 also rotates at one half the rate of shaft S12 during energization of motor M12. Vibration damping unit VD1 is positioned substantially midway between an upper position and elevator car C12 and, similarly, vibration damping unit VD2 is positioned substantially midway between a lower position and elevator car C15, which relative positions are maintained by the above-described drive mechanism.

In brief, during operation of drive motor M12, paired elevator cars C12 and C15 are simultaneously moved in opposite directions through interconnecting drive ropes 124, as described above. Simultaneously, paired vibration damping units VD1 and VD2 are moved in opposite directions through interconnecting drive ropes 118A and 118B at one-half the speed of elevator cars C12 and C15 upon operation of drive motor M12. The direction of movement of vibration damping units VD1 and VD2 is the same as that of associated elevator cars C12 and C15, respectively, to maintain the above-described midway location of the vibration damping units.

Figure 5:
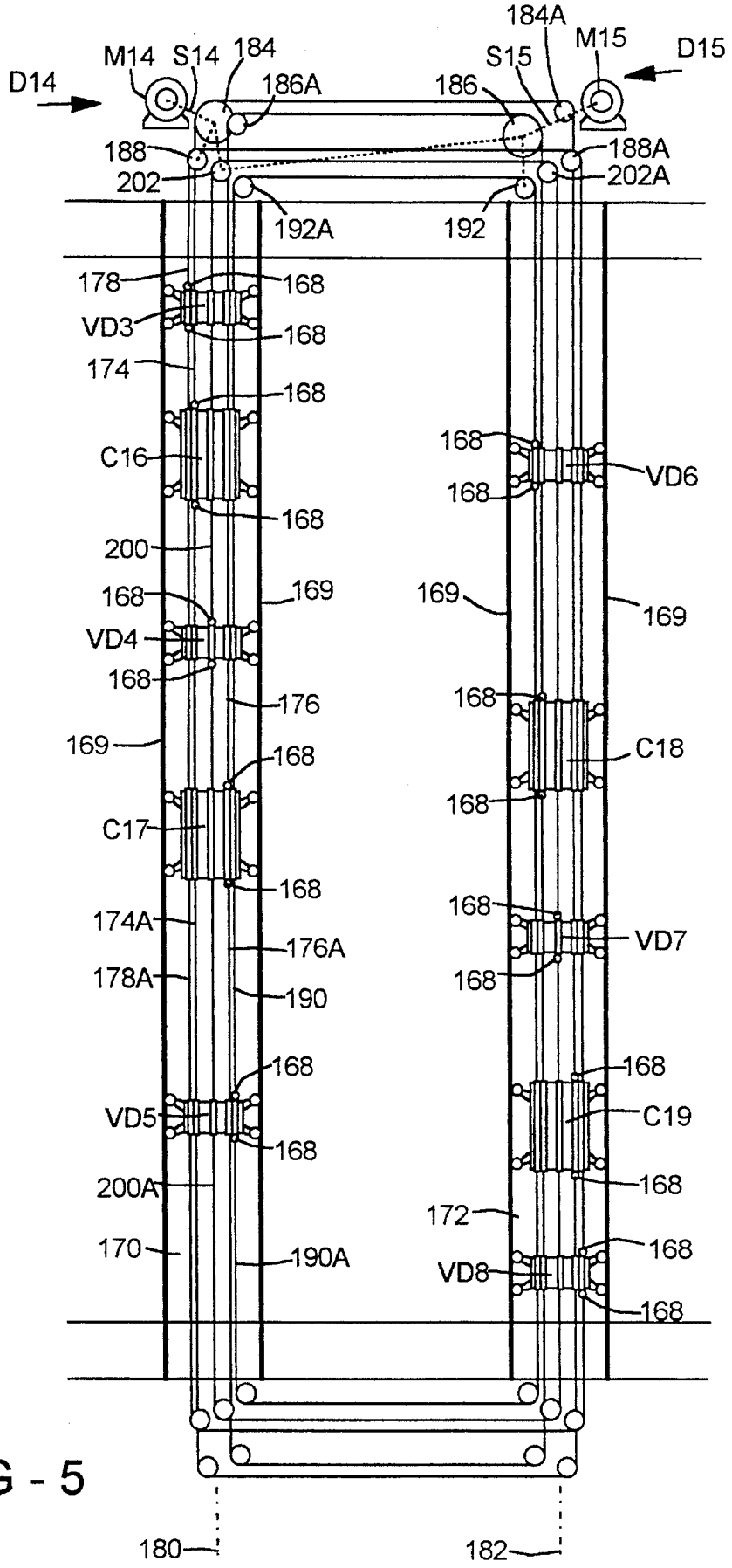
FIG. 5 is a simplified diagrammatic elevational view of yet another modified form of elevator system embodying the present invention.
Figure 6:
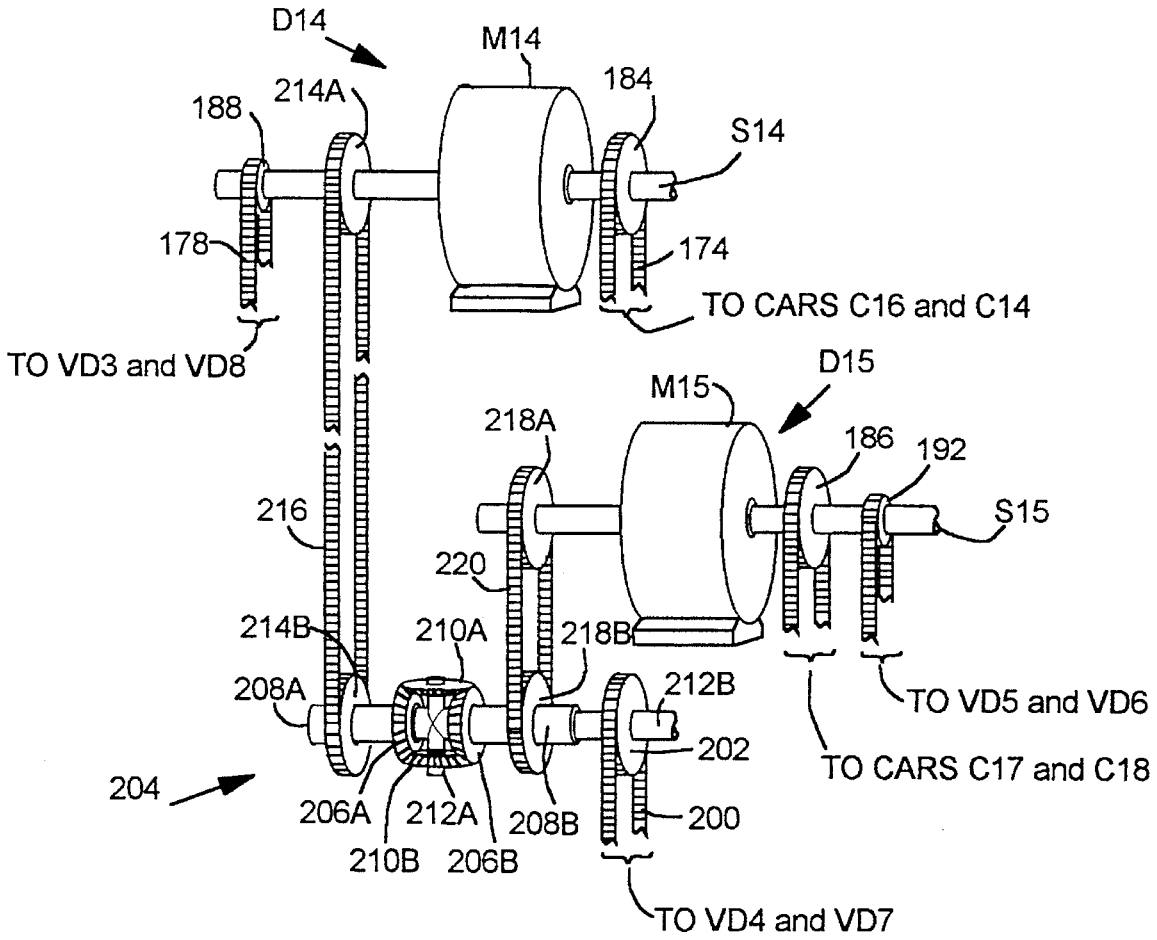
FIG. 6 is a fragmentary diagrammatic perspective view showing details of a drive system for use in the elevator system of FIG. 5.

Another modified form of this invention is shown in FIGS. 5 and 6 of the drawings, to which figures reference now is made. As in other embodiments of this invention, the system shown in FIG. 5 includes first and second parallel elevator shafts 170 and 172, in each of which shafts a plurality of elevator cars operate. For purposes of illustration, two vertically movable elevator cars C16 and C17 are included in elevator shaft 170, and two elevator cars C18 and C19 are included in elevator shaft 172. As in the FIG. 4 embodiment, a first vertically movable vibration damping unit VD3 is located above elevator car C16 in elevator shaft 170, and an associated vibration damping unit VD8 is located beneath elevator car C19 in elevator shaft 172. Although each elevator car and each vibration damping unit is provided with a plurality of drive and compensating ropes, for simplicity, only one such hoisting and compensating rope for each elevator car and vibration damping unit is shown in FIG. 5. Also, in FIG. 5, attachment lugs 168 are shown at those elevator cars and vibration damping units where drive and compensating ropes are affixed thereto. Where no attachment lugs are shown, the drive and compensating ropes extend through vibration damping means affixed to the elevator cars and vibration damping units, which vibration damping units may be of the same type shown in FIGS. 2 and 3 described above. Also, guide rails 169 for the elevator cars and vibration damping units are shown for guiding the same along vertical axes 180 and 182.

Elevator cars C16 and C19 are interconnected by drive rope 174, elevator cars C17 and C18 are interconnected by drive rope 176, and vibration damping units VD3 and VD8 are interconnected by drive rope 178. Drive means D14 and D15, comprising drive motors M14 and M15, are connected to the respective pairs of cars C16 and C19, and C17 and C18, through their associated drive ropes 174 and 176 for moving the elevator cars within the elevator shafts 170 and 172 along the vertical axes 180 and 182. (See also FIG. 6 for details of the drive means.) Motor shafts of motors M14 and M15 are identified by reference characters S14 and S15, respectively.

Drive rope 174 for cars C16 and C19 is wound around drive sheave 184 affixed to motor shaft S14. From drive sheave 184, drive rope 174 passes over idler sheave 184A in the connection thereof to car C19. Drive rope 176 for cars C17 and C18 extends upwardly from car C17, over idler sheave 186A, around drive sheave 186 affixed to motor shaft S15, and thence downwardly to car C18. Drive rope 178 for vibration damping units VD3 and VD8 extends upwardly from vibration damping unit VD3, around drive sheave 188 connected to drive shaft S14 of motor M14, over idler sheave 188A, and thence downwardly to vibration damping unit VD8. Drive sheave 188 for the vibration damping units VD3 and VD8 is one-half the diameter of drive sheave 184 for elevator cars C16 and C19 whereby the vibration damping units are driven at one-half the speed of the associated elevator cars upon energization of motor M14. As in the FIG. 4 arrangement, vibration unit VD3 is positioned substantially midway between an upper position and elevator car C16 and, vibration damping unit VD8 is positioned substantially midway between a lower position and elevator car C19, which relative positions are maintained during operation of drive motor M14 for elevator cars C16 and C19. It here will be noted that the FIG. 5 elevator cars C16–C19, and vibration damping units VD3 and VD8, may be driven by drive means of substantially the same type as shown in FIG. 4 described above.

The FIG. 5 embodiment differs from the FIG. 4 embodiment by the inclusion of two additional vertically movable vibration damping units, VD4 and VD5 in elevator shaft 170 and two additional vertically movable vibration damping units VD6 and VD7 in elevator shaft 172. Vibration damping unit VD4 remains substantially midway between elevator cars C16 and C17 during vertical movement of the elevator cars. Similarly, vibration damping unit VD7 remains substantially midway between elevator cars C18 and C19 during vertical movement thereof. Drive means for vibration damping units VD4 and VD7 are shown in detail in FIG. 6. First, however, drive means for vibration damping units VD5 and VD6 will be described.

Vibration damping units VD5 and VD6 are interconnected by drive rope 190 which extends upwardly from vibration damping unit VD5, over idler sheave 192A, around drive sheave 192 affixed to motor shaft S15 of drive motor M15, and thence downwardly to vibration damping unit VD6. Drive sheave 192 for the vibration damping units VD5 and VD6 is one-half the diameter of drive sheave 186 for elevator cars C17 and C18 whereby the vibration damping units are driven at one-half the speed of the associated elevator cars upon energization of motor M15. Vibration damping unit VD5 is positioned substantially midway between a lower position and elevator car C17 and, vibration damping unit VD8 is positioned substantially midway between an upper position and elevator car C18, which relative positions are maintained during operation of drive motor M15 for elevator cars C17 and C18.

Vibration damping units VD4 and VD7 are interconnected by drive rope 200 which extends upwardly from vibration damping unit VD4, around drive sheave 202 connected to both motors M14 and M15 through differential means 204 shown in FIG. 6, over idler sheave 202A, and thence downwardly to vibration damping unit VD7. Differential means 204 may be of any conventional type such as the illustrated bevel gear differential shown in FIG. 6. As seen in FIG. 6, differential 204 includes end, or sun, gears 206A and 206B affixed to tubular shafts 208A and 208B respectively. Spider, or planet, gears 210A and 210B which mesh with sun gears 206A and 206B are rotatably mounted on spider cross-shaft 212A. Cross-shaft 212A, in turn, is affixed to spider shaft 212B which is rotatably mounted in tubular shafts 208A and 208B. Spider shaft 212B comprises the output from differential 204 to which shaft drive sheave 202 is affixed.

Inputs to sun gears 206A and 206B of differential 204 are obtained from drive motors M14 and M15, respectively. As seen in FIG. 6, motor shaft S14 is connected to sun gear 206A through sheaves 214A and 214B affixed to shaft S14 and tubular shaft 208A, respectively, and belt 216 between the sheaves. Similarly, motor shaft S15 is connected to the second sun gear 206B through sheaves 218A and 218B affixed to shaft S15 and tubular shaft 208B, respectively, and belt 218 extending between the sheaves.

The elevator cars C16 through C19 and vibration damping units VD3 through VD8 are provided with compensating ropes in which compensating rope 174A extends between elevator cars C16 and C19, compensating rope 176A extends between elevator cars C17 and C18, compensating rope 178A extends between movable vibration damping units VD3 and VD8, compensating rope 190A extends between movable vibration damping units VD5 and VD6, and compensating rope 200A extends between vibration damping units VD4 and VD7. The compensating ropes extend over idler sheaves adjacent the bottom of the elevator shafts 170 and 172.

In operation of the FIG. 5 and 6 embodiment, elevator cars C16 and C19 are moved in opposite directions, and movable vibration damping units VD3 and VD8 are moved in the same direction as cars C16 and C19, respectively, but at one-half the velocity of cars C16 and C19 upon operation of motor M14. Similarly, elevator cars C17 and C18 are moved in opposite directions, and movable vibration damping units VD5 and VD6 are moved in the same direction as cars C17 and C18, respectively, but at one-half the velocity of cars C17 and C18 upon operation of motor M15. As is well understood, the rotational rate of differential output shaft 212B is one-half the sum of the rotational rates of the differential input shafts 208A and 208B. Consequently, if only one drive motor M14 or M15 is energized, differential output shaft 212B is rotated at one-half the rate of rotation of the associated differential input shaft 208A or 208B. If both motors are operated at the same speed such that cars C16 and C17 travel in one direction at the same speed and cars C18 and C19 travel in the opposite direction at that same speed, then vibration damping units VD4 and VD7 will be moved in the respective one and opposite directions at the same speed as the elevator cars so as to remain positioned midway between the associated elevator cars. If both motors M14 and M15 operate at the same speed such that cars C16 and C17 travel in opposite directions at the same speed and cars C18 and C19 also travel in opposite directions at the same speed, then the differential output shaft 212B is not rotated and the vibration damping units VD4 and VD7 remain stationary midway between the moving cars. The damping affect provided by the vibration damping means included in the movable vibration damping units is substantially maximized by movably positioning the vibration damping units in the manner described above.

Figure 7:
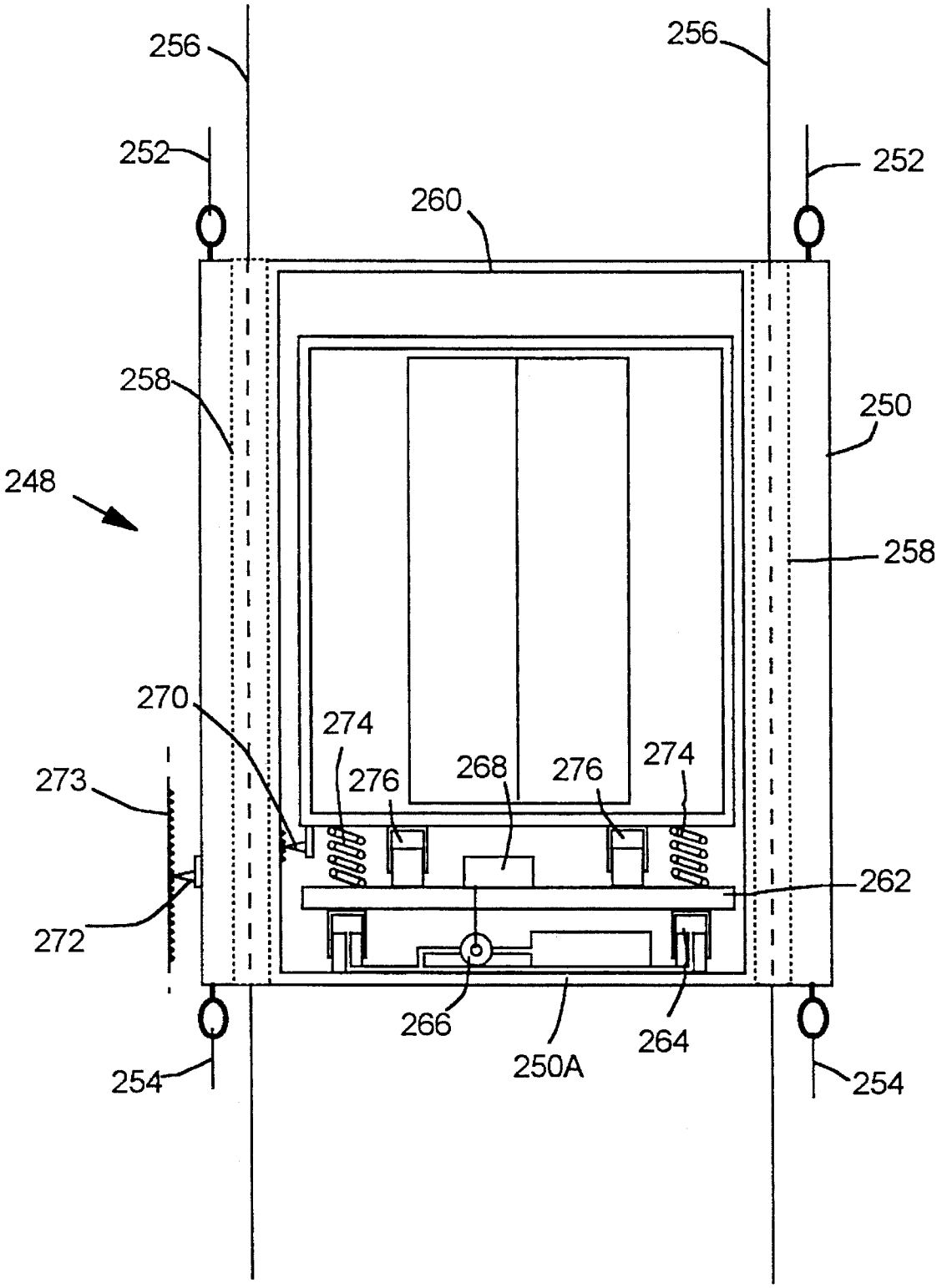
FIG. 7 is a diagrammatic elevational view of an elevator car showing means for isolating a passenger cage from vertical vibration of the associated car frame.

In addition to the above-described vibration damping means, the elevator cars may be designed to substantially isolate passengers from vibration, including vibration produced by vibration of drive rope means. One such elevator car is shown in FIG. 7, to which figure reference now is made. There, an elevator car 248 is shown which includes a car frame 250 to which drive ropes 252 and compensating ropes 254 are affixed. Drive ropes 256 for another elevator car, not shown, beneath car 248 extend through vibration damping means 258 affixed to car frame 250. The vibration damping means 258, which are shown in broken lines, may be of the same type shown in FIGS. 2 and 3 described above.

Passenger car frame 250 includes a base member 250A for support of a passenger cage 260 within the car frame, which passenger cage may be of any conventional design. A vertically movable platform 262 is supported on base member 250A of the car frame. Means, such as hydraulic piston and cylinder means 264 between base member 250A and platform 262, are used for adjusting the height of the platform above the base member. The hydraulic cylinders are supplied with fluid under pressure by a pump 266 which pump is controlled by the output from a computer 268 for adjusting fluid to the cylinders and, consequently, the level of platform 262 above base member 250A. Inputs for the computer are obtained from load sensing means 270 for obtaining a measure of loading of the passenger cage 260, and from position sensing means 272 for obtaining a measure of vertical position of the elevator car frame along the elevator shaft. Load sensing means 270 provides a measure of vertical vibration of passenger cage 260 relative to car frame 250, and position sensing means 272 provides a measure of vertical vibration of the car frame relative to the elevator shaft 273.

Passenger cage 260 is supported on resilient biasing means 274, such as the illustrated springs affixed to vertically movable platform 262. Shock absorber means 276 between the platform and passenger cage damp vertical vibration of the passenger cage. Outputs from both the load sensing means 270 and car frame position sensing means 272 are processed by computer 268 in determining the amount of vertical movement of platform 262 required for reducing vertical vibration of said passenger cage 260 during elevator car movement. With this arrangement, vertical vibration of car frame 250 produced, for example, by wobbling of the drive ropes 252 affixed thereto is detected by car frame position sensing means 272 having an output supplied to computer 268. Similarly, vertical vibration of passenger cage 260 relative to car frame 250 is detected by passenger load sensor 270 having an output that also is supplied to computer 268. Computer 268 processes these inputs and produces an output that controls pump 266 for controlling the vertical position of passenger cage 260 within car frame 250. Control provided by computer 268 results in a substantially equal but opposite vibration of the passenger cage, relative to the car frame, to vertical vibration of the car frame relative to the elevator shaft during travel along the elevator shaft. With the illustrated negative feedback arrangement, the passenger cage is substantially isolated from vibration of the car frame.

The invention having been described in detail in accordance with requirements of the patent statutes, various other changes and modifications will suggest themselves to those skilled in this art. For example, it will be apparent that more than three elevator cars may be included in each elevator shaft. Also, instead of using separate drive and compensating ropes, drive and compensating rope means for associated pairs of cars may be integrally formed, to which integrally formed rope elevator cars and movable vibration damping units are affixed. It is intended that these and other such changes and modifications shall fall within the scope of the invention defined in the appended claims.

I claim:

1. An elevator system for a multistory structure having a plurality of floors comprising:

first and second horizontally spaced vertical elevator shafts, first and second elevator cars in said first elevator shaft movable along a first vertical axis independently of each other, said first elevator car being located above said second elevator car, third and fourth elevator cars in said second elevator shaft movable along a second vertical axis independently of each other, said fourth elevator car being located above said third elevator car, first drive rope means connected to said second and fourth elevator cars, first drive means connected to said first drive rope means for simultaneously moving said second and fourth elevator cars in opposite directions along said first and second vertical axes, second drive rope means connected to said first and third elevator cars, and second drive means connected to said second drive rope means for simultaneously moving said first and third elevator cars in opposite directions along said first and second vertical axes.

2. An elevator system as defined in claim 1 including, a plurality of vibration damping means, at least some of said vibration damping means being affixed to said first elevator car, said first drive rope means extending through at least some of said vibration damping means that are affixed to said first elevator car for damping vibration of said first drive rope means thereat.

3. An elevator system as defined in claim 2 wherein, at least some of said plurality of vibration damping means are affixed to said fourth elevator car, said second drive rope means extends through at least some of said vibration damping means that are affixed to said fourth elevator car for damping vibration of said second drive rope means thereat.

4. An elevator system as defined in claim 2 wherein said vibration damping means affixed to said first elevator car through which said first drive rope means extends comprises at least one pair of space sheaves engaged with and between which said first drive rope means extend for substantially preventing transverse motion of said first drive rope means thereat.

5. An elevator system as defined in claim 1 including, a fifth elevator car in said first elevator shaft movable along said first vertical axis independently of said first and second elevator cars, said fifth elevator car being located beneath said second elevator car, a sixth elevator car in said second elevator shaft movable along said second vertical axis independently of said third and fourth elevator cars, said sixth elevator car being located above said fourth elevator car, third drive rope means connected to said fifth and sixth elevator cars, and third drive means connected to said third drive rope means for simultaneously moving said fifth and sixth elevator cars in opposite directions along said first and second vertical axes.

6. An elevator system as defined in claim 1 including, first compensating rope means connected to said second and fourth elevator cars, and second compensating rope means connected to said first and third elevator cars.

7. An elevator system as defined in claim 6 including, a plurality of vibration damping means, at least some of said vibration damping means being affixed to said second elevator car, said second compensating rope means extending through at least some of said vibration damping means that are affixed to said second elevator car for damping vibration of said second compensating rope means thereat, at least some of said vibration damping means being affixed to said third elevator car, and said first compensating rope means extending through at least some of said vibration damping means that are affixed to said third elevator car for damping vibration of said first compensating rope means thereat.

8. An elevator system as defined in claim 1 wherein, said first drive rope means is integrally formed with said first compensating rope means, and said second drive rope means is integrally formed with said second compensating rope means.

9. An elevator system as defined in claim 1 including, a first movable vibration damping unit located above said first elevator car and movable along said first vertical axis, third drive rope means connected to said first movable vibration damping unit, means including said third drive rope means for moving said first movable vibration damping unit along said first vertical axis in the direction of movement of said first elevator car during operation of said second drive means, a plurality of vibration damping means, at least some of said vibration damping means being affixed to said first vibration damping unit, said first and second drive rope means extending through vibration damping means affixed to said first vibration damping unit for damping vibration of said first and second drive rope means thereat.

10. An elevator system as defined in claim 9 including, a second movable vibration unit located beneath said third elevator car and movable along said second vertical axis, said third drive rope means being connected to said second movable vibration damping unit, said second movable vibration damping unit being simultaneously movable along said second vertical axis in the direction of movement of said third elevator car during operation of said second drive means, at least some of said plurality of vibration damping means being affixed to said second vibration damping unit, first compensating rope means connected to said second and fourth elevator cars, second compensating rope means connected to said first and third elevator cars, said first and second compensating rope means extending through vibration damping means affixed to said second vibration damping unit for damping vibration of said first and second compensating rope means thereat.

11. An elevator system as defined in claim 10 including 2-to-1 speed reducing means for connecting said second drive means to said third drive rope means for movement of said first and second movable vibration damping units at substantially one-half the rate of movement of said first and third elevator cars.

12. An elevator system as defined in claim 1 including, a first movable vibration damping unit located intermediate said first and second elevator cars and movable along said first vertical axis, a second movable vibration damping unit located intermediate said third and fourth elevator cars and movable along said second vertical axis, means including said first and second drive means for maintaining said first and second movable vibration damping units substantially midway between said first and second elevator cars and said third and fourth elevator cars, respectively, a plurality of vibration damping means at least some of which are affixed to said first movable vibration damping unit and others of which are affixed to said second movable vibration damping unit, said first drive rope means extending through at least some of said vibration damping means affixed to said first movable vibration damping unit for damping vibration of said first drive rope means thereat, and said second drive rope means extending through at least some of said vibration damping means affixed to said second movable vibration damping unit for damping vibration of said second drive rope means thereat.

13. An elevator system as defined in claim 1 wherein at least one of said elevator cars in one of said vertical shafts comprises, a car frame and passenger cage, one of said drive rope means being affixed to said car frame for moving said car frame and associated passenger car along one of said vertical axes, means for moving said passenger cage up and down relative to the car frame, first sensing means for measuring vertical vibration of the passenger cage relative to the car frame, second sensing means for measuring vertical vibration of the car frame relative to the associated vertical elevator shaft during travel along said elevator shaft, and means responsive to said first and second sensing means for controlling said moving means for vibrating said passenger cage relative to the car frame to substantially isolate said passenger cage from vertical vibration of said car frame.

14. An elevator system as defined in claim 13 wherein said means for moving said passenger cage up and down relative to the car frame comprises, fluid cylinder means for supporting the passenger cage on the car frame, and fluid pump means under control of said means responsive to said first and second sensing means for supplying fluid to said fluid cylinder means.

15. An elevator system as defined in claim 13 including resilient biasing means for connecting said passenger cage to said means for moving said passenger cage up and down relative to the car frame.

* * * * *